US005087544A

United States Patent [19]

Muto et al.

[11] Patent Number: 5,087,544

[45] Date of Patent: Feb. 11, 1992

[54] PERYLENE ELECTROPHOTOSENSITIVE MATERIAL WITH M-PHENYLENEDIAMINE

[75] Inventors: Nariaki Muto, Daito; Mikio Kakui, Mino; Keisuke Sumida, Hirakata; Toru Nakazawa, Osaka; Kazuo Matsumoto, Hirakata, all of Japan

[73] Assignee: Mita Industrial Co., Ltd., Osaka, Japan

[21] Appl. No.: 498,647

[22] Filed: Mar. 26, 1990

[30] Foreign Application Priority Data

Mar. 30, 1989 [JP] Japan ..... 1-80019

[51] Int. Cl.[5] ..... G03G 5/06; G03G 5/09

[52] U.S. Cl. ..... 435/83; 430/59

[58] Field of Search ..... 430/59, 83

[56] References Cited

U.S. PATENT DOCUMENTS 3,615,404 10/1971 Price ..... 480/74

FOREIGN PATENT DOCUMENTS 37356 2/1990 Japan ..... 430/59

*Primary Examiner*—Roland Martin

*Attorney, Agent, or Firm*—Beveridge, DeGrandi & Weilacher

[57] ABSTRACT

The present invention provides an electrophotosensitive material comprising a conductive substrate, and a photosensitive layer provided on the conductive substrate and containing a m-phenylenediamine compound represented by the general formula [I]:

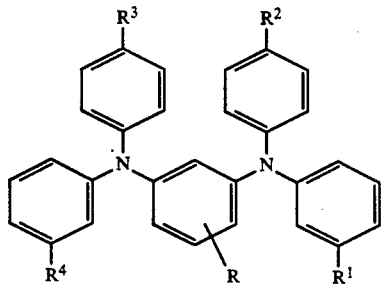

(wherein $R^1$, $R^2$, $R^3$, $R^4$ and R are the same as defined before). The present electrophotosensitive material has high sensitivity and is easy to be manufactured.

4 Claims, No Drawings

PERYLENE ELECTROPHOTOSENSITIVE MATERIAL WITH M-PHENYLENEDIAMINE

BACKGROUND OF THE INVENTION

The present invention relates to an electrophotosensitive material suitably used in an image forming apparatus such as an electrophotographic copying apparatus.

Recent years, it is a common practice to use, as the electrophotosensitive material used in an image forming apparatus such as an electrophotographic copying apparatus, an organic photosensitive material economically manufactured because of good workability and having a great degree of freedom of function designing. Particularly, there is proposed an electrophotosensitive material of the function separated type having a photosensitive layer containing a charge-generating material for generating an electric charge by light irradiation and a charge-transferring material for transferring the generated electric charge.

In the electrophotosensitive material of the function separated type above-mentioned, the characteristics of the charge-generating material and the charge-transferring material exert a great influence upon the electric and photosensitive characteristics of the resultant electrophotosensitive material. Accordingly, studies have been made on a variety of substances. As the charge-transferring material, there are proposed a variety of substances such as polyvinylcarbozol, oxadiazol compounds, pyrazoline compounds, hydrazone compounds and the like.

In the charge-transferring materials above-mentioned, however, the drift mobility representing the charge transferring ability is relatively small. Further, since the dependency of the drift mobility upon the electric field intensity is great, the movement of the charge in a low electric field is small. This makes it difficult that the residual potential disappears. Further, such materials are disadvantageously apt to be deteriorated due to irradiation of ultraviolet rays or the like.

On the other hand, it is known that the charge-transferring material of the triphenylamine type presents a small dependency of the drift mobility upon the electric field intensity. For example, the U.S. Pat. No. 3,265,496 discloses, as examples of such a material, N,N,N',N'-tetraphenylbenzidine, N,N,N',N'-tetraphenyl-1,4-phenylenediamine, N,N,N',N'-tetraphenyl-1,3-phenylenediamine and the like. These charge-transferring materials have good molecular symmetry so that the interaction among the molecules is great and the interaction with the resin is small. This presents the problem that these materials are apt to be crystallized in the resin. Thus, these charge-transferring materials cannot be practically used.

In view of the problems above-mentioned, the inventors of the present invention have proposed as a compound presenting a small dependency of the drift mobility upon the electric field intensity and a good compatibility with the resin, a m-phenylenediamine compound which may contain any number of substituents as far as such substituents may be introduced to the respective phenyl rings of N,N,N', N'-tetraphenyl-1,3-phenylenediamine (Japanese Patent Application No. 301703/1987).

Further the inventors of the present invention have found that, when the m-phenylenediamine compound is applied to the electrophotosensitive material, the characteristics of the electrophotosensitive material depend on the positions of the substituents contained in the phenyl rings of the m-phenylenediamine compound.

More specifically, the inventors of the present invention have found that the compound containing substituents introduced to the para-positions of the phenyl rings of the N,N,N',N'-tetraphenyl-1,3-phenylenediamine with respect to the position wherein nitrogen atoms are bonded, presents a high carrier injection efficiency and a great carrier mobility (Japanese Patent Application No.187311/1988). The inventors of the present invention have also found that the compound containing substituents introduced to the meta-position of the respective phenyl rings of the N,N,N',N'-tetra-phenyl-1,3-phenylenediamine with respect to the position wherein nitrogen atoms are bonded, presents a small symmetry of molecules so that the interaction of the molecules is small, and also presents a great interaction with the resin so that the compound is hard to be crystallized in the resin (Japanese Patent Application No.187312/1988).

When the compound above-mentioned containing the substituents introduced t the para-positions is applied to the electrophotosensitive material, this electrophotosensitive material presents high sensitivity. However, when this compound is used in a high concentration, it is disadvantageously apt to be crystallized. The compound containing the substituents introduced to the meta-positions is superior in that this compound is hard to be crystallized. However, this compound presents a low yield to decrease the productivity. Accordingly, when this compound is applied to the electrophotosensitive material, the electrophotosensitive material itself is high in cost.

SUMMARY OF THE INVENTION

It is an object of the present invention to provide an economical electrophotosensitive material having high sensitivity.

The present invention provides an electrophotosensitive material having, on a conductive substrate, a sensitive layer containing a m-phenylenediamine compound represented by the following general formula

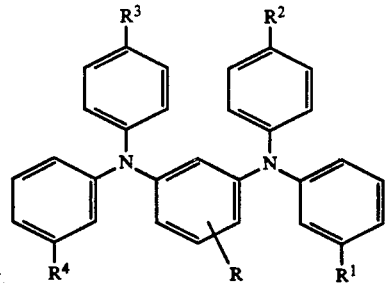

(wherein $R^1$, $R^2$, $R^3$, $R^4$ and R are the same as one another, or are different from one another, and represent a hydrogen atom, an alkyl group, an alkoxy group or a halogen atom, provided that, when one of $R^1$ and $R^4$ is the hydrogen atom, the other should not be the hydrogen atom, and when one of $R^2$ and $R^3$ is the hydrogen atom, the other should not be the hydrogen atom).

The m-phenylenediamine compound represented by the general formula [I] contains phenyl rings in which the substituents are introduced to the para-position with respect to the position wherein the nitrogen atoms are bonded, and phenyl rings in which the substituents are introduced to the meta-positions with respect to the position wherein the nitrogen atom are bonded. Accordingly, as compared with the compound containing substituents introduced to the para-positions with respect to the position wherein nitrogen atom are bonded in the phenyl rings of the N,N,N', N'-tetraphenyl-1,3-phenylenediamine, the m-phenylenediamine compounds above mentioned presents a small symmetry of molecules so that the interaction of the molecules is small and the interaction with the resin is great.

Accordingly, even through added in a high concentration to resin, the m-phenylenediamine compound represented by the general formula [I] is hard t be crystallized. Therefore, this compound may be sufficiently dissolved in the resin, thereby to improve the drift mobility. Thus, a highly sensitive electrophotosensitive material may be obtained.

As compared with the compound containing substituents introduced to the meta-positions with respect to the position wherein the nitrogen atom are bonded in the phenyl rings of the N,N,N',N'-tetraphenyl-1,3-phenylenediamine, the compound represented by the general formula [I] presents a high yield to improve the productivity, enabling to produce an ecomomical electro-photosensitive material.

DETAILED DESCRIPTION OF THE INVENTION

The m-phenylenediamine compound used for an electrophotosensitive material in accordance with the present invention is represented by the general formula [I]. In $R^1$, $R^2$, $R^3$, $R^4$ and R in this formula, an example of the alkyl group is a $C_1$–$C_6$ alkyl group such as methyl, ethyl, propyl, isopropyl, butyl, isobutyl, tert-butyl, pentyl, hexyl or the like. An example of the alkoxy group is a $C_1$–$C_6$ alkoxy group such as methoxy, ethoxy, propoxy, isopropoxy, butoxy, isobutoxy, tert-butoxy, pentyloxy, hexyloxy or the like. An example of the halogen atom includes fluorine, chlorine, bromine, and iodine atom.

The position to which R is introduced, is not specially limited, but may be introduced to, for example, the fifth position.

Table 1 shows typical examples of the m-phenylenediamine compound represented by the general formula [I].

TABLE 1

| R | $R^1$ | $R^2$ | $R^3$ | $R^4$ |
|---|---|---|---|---|
| $CH_3$ | $CH_3$ | $C_2H_5$ | $C_2H_5$ | $CH_3$ |
| $CH_3$ | $CH_3$ | $C_3H_7$ | $C_3H_7$ | $CH_3$ |
| $CH_3$ | $CH_3$ | $C(CH_3)_3$ | $C(CH_3)_3$ | $CH_3$ |
| $CH_3$ | $CH_3$ | $OCH_3$ | $OCH_3$ | $CH_3$ |
| $CH_3$ | $CH_3$ | $OC_2H_5$ | $OC_2H_5$ | $C_2H_5$ |
| $CH_3$ | $C_2H_5$ | $CH_3$ | $CH_3$ | $C_2H_5$ |
| $CH_3$ | $C_3H_7$ | $CH_3$ | $CH_3$ | $C_3H_7$ |
| $CH_3$ | $C(CH_3)_3$ | $CH_3$ | $CH_3$ | $C(CH_3)_3$ |
| $CH_3$ | $OCH_3$ | $CH_3$ | $CH_3$ | $OCH_3$ |
| $CH_3$ | $OC_2H_5$ | $CH_3$ | $CH_3$ | $OC_2H_5$ |
| $C_2H_5$ | $CH_3$ | $C_2H_5$ | $C_2H_5$ | $CH_3$ |
| $C_2H_5$ | $CH_3$ | $C_3H_7$ | $C_3H_7$ | $CH_3$ |
| $C_2H_5$ | $CH_3$ | $C(CH_3)_3$ | $C(CH_3)_3$ | $CH_3$ |
| $C_2H_5$ | $CH_3$ | $OC_2H_5$ | $OC_2H_5$ | $CH_3$ |
| $C_2H_5$ | $CH_3$ | $OCH_3$ | $OCH_3$ | $CH_3$ |
| $C_2H_5$ | $C_2H_5$ | $CH_3$ | $CH_3$ | $C_2H_5$ |
| $C_2H_5$ | $C_3H_7$ | $CH_3$ | $CH_3$ | $C_3H_7$ |
| $C_2H_5$ | $C(CH_3)_3$ | $CH_3$ | $CH_3$ | $C(CH_3)_3$ |
| $C_2H_5$ | $OCH_3$ | $CH_3$ | $CH_3$ | $OCH_3$ |
| $C_2H_5$ | $OC_2H_5$ | $CH_3$ | $CH_3$ | $OC_2H_5$ |
| $C_3H_7$ | $CH_3$ | $C_2H_5$ | $C_2H_5$ | $CH_3$ |
| $C_3H_7$ | $CH_3$ | $C_3H_7$ | $C_3H_7$ | $CH_3$ |
| $C_3H_7$ | $CH_3$ | $C_2H_5$ | $C_2H_5$ | $CH_3$ |
| $C_3H_7$ | $C_2H_5$ | $CH_3$ | $CH_3$ | $C_2H_5$ |
| $C_3H_7$ | $C_3H_7$ | $CH_3$ | $CH_3$ | $C_3H_7$ |
| $C_3H_7$ | $OC_2H_5$ | $CH_3$ | $CH_3$ | $OC_2H_5$ |
| $C_3H_7$ | $C(CH_3)_3$ | $CH_3$ | $CH_3$ | $C(CH_3)_3$ |
| $C_3H_7$ | $OCH_3$ | $CH_3$ | $CH_3$ | $OCH_3$ |
| $C(CH_3)_3$ | $CH_3$ | $C_2H_5$ | $C_2H_5$ | $CH_3$ |
| $C(CH_3)_3$ | $CH_3$ | $C(CH_3)_3$ | $C(CH_3)_3$ | $CH_3$ |
| $C(CH_3)_3$ | $CH_3$ | $OCH_3$ | $OCH_3$ | $CH_3$ |
| $C(CH_3)_3$ | $CH_3$ | $OC_2H_5$ | $OC_2H_5$ | $CH_3$ |
| $C(CH_3)_3$ | $C_2H_5$ | $CH_3$ | $CH_3$ | $C_2H_5$ |
| $C(CH_3)_3$ | $C(CH_3)_3$ | $CH_3$ | $CH_3$ | $C(CH_3)_3$ |
| $C(CH_3)_3$ | $OCH_3$ | $CH_3$ | $CH_3$ | $OCH_3$ |
| $C(CH_3)_3$ | $OC_2H_5$ | $CH_3$ | $CH_3$ | $OC_2H_5$ |
| $OCH_3$ | $CH_3$ | $C_2H_5$ | $C_2H_5$ | $CH_3$ |
| $OCH_3$ | $CH_3$ | $C(CH_3)_3$ | $C(CH_3)_3$ | $CH_3$ |
| $OCH_3$ | $CH_3$ | $OCH_3$ | $OCH_3$ | $CH_3$ |
| $OCH_3$ | $C(CH_3)_3$ | $CH_3$ | $CH_3$ | $C(CH_3)_3$ |
| $OC_2H_5$ | $OC_2H_5$ | $CH_3$ | $CH_3$ | $OC_2H_5$ |
| $C_2H_5$ | $C_2H_5$ | $C_2H_5$ | $C_2H_5$ | $C_2H_5$ |
| $C_3H_7$ | $C_3H_7$ | $C_3H_7$ | $C_3H_7$ | $C_3H_7$ |
| $C(CH_3)_3$ | $C(CH_3)_3$ | $C(CH_3)_3$ | $C(CH_3)_3$ | $C(CH_3)_3$ |
| $OCH_3$ | $OCH_3$ | $OCH_3$ | $OCH_3$ | $OCH_3$ |
| $OC_2H_5$ | $OC_2H_5$ | $OC_2H_5$ | $OC_2H_5$ | $OC_2H_5$ |
| $OC_2H_5$ | $C_2H_5$ | $CH_3$ | $CH_3$ | $C_2H_5$ |
| $OC_2H_5$ | $C(CH_3)_3$ | $CH_3$ | $CH_3$ | $C(CH_3)_3$ |
| $OC_2H_5$ | $OCH_3$ | $CH_3$ | $CH_3$ | $OCH_3$ |
| $CH_3$ | $CH_3$ | $CH_3$ | $CH_3$ | $CH_3$ |
| $C_2H_5$ | $CH_3$ | $CH_3$ | $CH_3$ | $CH_3$ |
| $C_3H_7$ | $CH_3$ | $CH_3$ | $CH_3$ | $CH_3$ |
| $C(CH_3)_3$ | $CH_3$ | $CH_3$ | $CH_3$ | $CH_3$ |
| $OCH_3$ | $CH_3$ | $CH_3$ | $CH_3$ | $CH_3$ |
| $OC_2H_5$ | $CH_3$ | $CH_3$ | $CH_3$ | $CH_3$ |
| $OCH_3$ | $CH_3$ | $OC_2H_5$ | $OC_2H_5$ | $CH_3$ |
| $OCH_3$ | $C_2H_5$ | $CH_3$ | $CH_3$ | $C_2H_5$ |
| $OCH_3$ | $OCH_3$ | $CH_3$ | $CH_3$ | $OCH_3$ |
| $OCH_3$ | $OC_2H_5$ | $CH_3$ | $CH_3$ | $OC_2H_5$ |
| $OC_2H_5$ | $CH_3$ | $C_2H_5$ | $C_2H_5$ | $CH_3$ |
| $OC_2H_5$ | $CH_3$ | $C(CH_3)_3$ | $C(CH_3)_3$ | $CH_3$ |
| $OC_2H_5$ | $CH_3$ | $OCH_3$ | $OCH_3$ | $CH_3$ |
| $OC_2H_5$ | $CH_3$ | $OC_2H_5$ | $OC_2H_5$ | $CH_3$ |
| $CH_3$ | H | $CH_3$ | $CH_3$ | $CH_3$ |
| $CH_3$ | H | $CH_3$ | H | $CH_3$ |
| $CH_3$ | $CH_3$ | H | $CH_3$ | $CH_3$ |
| $CH_3$ | $CH_3$ | H | $CH_3$ | H |
| $CH_3$ | Br | $CH_3$ | $CH_3$ | $CH_3$ |
| Cl | $CH_3$ | $CH_3$ | $CH_3$ | $CH_3$ |
| $CH_3$ | $CH_3$ | F | $CH_3$ | $CH_3$ |

The compound represented by the general formula [I] according to the present invention may be composed by any of various methods, one of which will be described with reference to the following reaction:

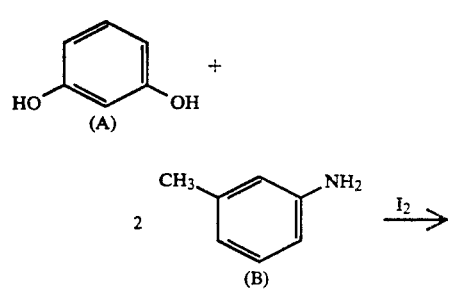

-continued

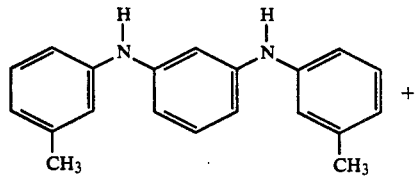

(C)

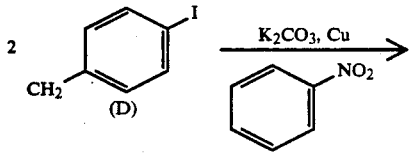

(D)

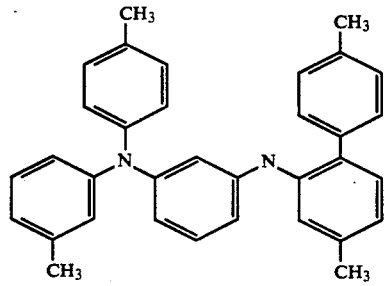

(E)

The resorcinol represented by the formula (A) above-mentioned, and the m-toluidine represented by the formula (B) above-mentioned, are reacted together with iodine under a stream of nitrogen, thereby to obtain N,N'-di(3-toryl)-1,3-phenylenediamine represented by the general formula (C). Then, the N,N'-di(3-toryl)-1,3-phenylenediamine and the p-iodotoluene represented y the formula (D) above-mentioned together with potassium carbonate and copper powder are reacted under reflux in nitrobenzene, thereby to obtain N,N'-di(3-toryl)-N,N'-di(4-toryl)-1,3-phenylenediamine represented by the formula (E) above-mentioned.

The electrophotosensitive material in accordance with the present invention is characterized by comprising, on a conductive substrate, a sensitive layer containing the m-phenylenediamine compound represented by the general formula [I]. The present electrophotosensitive material may be applied as either a sensitive material of a single layer type in which a single sensitive layer containing a charge-generating material and a charge-transferring material is disposed on the conductive substrate, or a multilayer-type electrophotosensitive material of a function separation type in which at least two layers of a charge-generating layer and a charge-transferring layer are laminated on the conductive substrate. The compound represented by the general formula [I] of the present invention may be used as combined with other known charge-transferring materials. As these other charge-transferring materials, there may be used conventional electron withdrawing compounds and electron releasing compounds.

Examples of the electron withdrawing compounds include tetracyanoethylene, 2,4,7-trinitro-9-fluorenone, 2,4,8-trinitrothioxanthone, 3,4,5,7-tetranitro-9-fluorenone, dinitorobenzene, dinitroanthracen, dinitroaquridine, nitroanthraquinone, dinitoroanthraquinone, succinic anhydride, maleic anhydride, dibromo maleic anhydride and the like.

Examples of the electron releasing compounds include oxadiazole compounds such as 2,5-di(4-methylaminophenyl)-1,3,4-oxadiazole and the like; styrile compounds such as 9-(4-diethylaminostyrile)anthracene; carbazole compounds such as polyvinylcarbazole; pyrazoline compounds such as 1-phenyl-3-(p-dimethylaminophenyl)pyrazoline and the like; hydrozone compounds; amine compounds such as triphenylamine; heterocyclic compounds having nitrogen atom or condensed polycyclic compounds such as indole compounds, oxazole compounds, isoxazole compounds, thiazole compounds, thiadiazole compounds, imidazole compounds, pyrazole compounds, triazole compounds and the like. Thee charge-transferring materials may be used either alone or in combination of plural types. When the charge-transferring material having a film forming ability such as polyvinylcarbazole or the like is used, binding resin is not necessarily required.

For forming, for example, the electrophotosensitive material of the single layer type, there may be formed, on the conductive substrate, a photosensitive layer containing (i) the compound represented by the general formula [I] as the charge-transferring material, (ii) a charge-generating material, and (iii) binding resin and the like. For forming the electrophotosensitive material of the multilayer type, a charge-generating layer containing the charge-generating material may be first formed on the conductive substrate by vapor-deposition, coating or other suitable methods, and a charge-transferring layer containing the compound represented by the general formula [I] and binding resin may be then formed on this charge-generating layer. On the contrary, a charge-transferring layer similar to that above-mentioned may be first formed on the conductive substrate, and a charge-generating layer containing the charge-generating material may be then formed on the charge-transferring layer by vapor-deposition, coating or other suitable methods. The charge-generating layer may be formed as coated by dispersing the charge-generating material and the charge-transferring material in the binding resin.

Examples of the charge-generating material include selenium, selenium-tellurium, amorphous silicone, pyrylium salt, azo pigment, bis-azo pigment, anthanthrone pigment, phthalocyanine pigment, indigo pigment, triphenylmethane pigment, indanthrene pigment, toluidine pigment, pyrazoline pigment, perylene pigment, quinacridone pigment, pyrrol pigment and the like. Meanwhile, these charge-generating materials may be used either alone or in combination of plural types in order to adjust absorbance wavelength to desired wavelength.

Examples of the binding resins contained in the photosensitive layer, the charge-transferring layer and the charge-generating layer include thermoplastic resin such as a styrene polymer, a styrene-butandiene copolymer, a styrene-acrylonitrile copolymer, a styrene-maleic acid copolymer, an acrylic polymer, a styrene-acrylic copolymer, polyethylene, an ethylenevinyl acetate copolymer, chlorinated polyethylene, polyvinyl chloride, polypropylene, a vinylchloridevinyl acetate copolymer, polyester, alkyd resin, polyamide, polyurethane, polycarbonate, polyarylate, polysulfide, diallyl phthalate resin, ketone resin, polyvinyl butyral resin, polyether resin and the like; cross-linking thermosetting resin such as silicone resin, epoxy resin, phenol resin, urea resin, melamine resin and the like; photosetting resin such as epoxyacrylate, urethane acrylate and the like. These binding resins may be used either alone or in combination of plural types.

In preparation of the charge-generating layer and charge-transferring layer by a coating method, various types of a solvent may be used. Examples of the solvent include alcohols such as methanol, ethanol, isopropanol, butanol and the like; aliphatic hydrocarbons such as n-hexane, octaine, cycrohexane and the like; aromatic hydrocarbons such as benzene, toluene, xylene and the like; halogenated hydrocarbons such as dichloromethane, dichloroethane, carbon tetrachloride, chlorobenzene and the like; ethers such as dimethyl ether, diethyl ether, tetrahydrofurane, ethylene glycol dimethyl ether, ethylene glycol diethyl ether, diethylene glycol dimethyl ether and the like; ketones such as acetone, methyl ethyl ketone, cyclohexanone and the like; esters such as ethyl acetate, methyl acetate and the like; dimethyl formamide; dimethylsulfoxide. These solvents are used either alone or in combination of two or more types.

To enhance the sensitivity of the charge-generating layer, there may be jointly used conventional sensitization agents such as terphenyl, halonaphtoquinone, acetylnaphtylene and the like. Further to enhance the distensibility or coating performance of the charge-generating material and the charge-transferring material, surface active agents or levelling agent may be used.

As the conductive substrate, various conductive materials may be used. Examples of the conductive materials include metallic single elements such as aluminium, copper, tin, platinum, gold, silver, vanadium, molybdenum, chromium, cadmium, titanium, nickel, palladium, indium, stainless steel, brass and the like; plastic materials which are plated or laminated with the metallic single element above-mentioned; glass materials which are coated with iodide aluminium, tin oxide, indium oxide or the like. The conductive substrate may be made in the form of a sheet or a drum. The substrate itself may be conductive or the surface of the substrate may be conductive. Preferably, the conductive substrate presents a sufficient mechanical strength when used.

The binding resin and the charge-transferring material of the present invention may be used at a variety of ratios within such a range as not to prevent the transmission of the electric charge and as to prevent the crystallization of the charge-transferring material. Preferably, 50 to 80 parts by weight, and more preferably 60 to 75 parts by weight, of the compound represented by the general formula [I] may be used with respect to 100 parts by weight of the binding resin.

The charge-transferring layer containing the compound represented by the general formula [I] may have a thickness of in a range from 2 to 100 μm and preferably from about 5 to about 30 μm.

When the charge-generating material and the binding resin above-mentioned are jointly used, they may be used at a variety of ratios. However, preferably 1 to 300 parts by weight and more preferably 5 to 150 parts by weight of the binding resin may be used with respect to 10 parts by weight of the charge-generating material. The charge-generating layer may have a suitable thickness, but may have a thickness of preferably 0.01 to 20 μm and more preferably about 0.1 to about 10 μm.

Within such a range as not to impede the characteristics of the photosensitive material, a barrier layer may be formed, for the electrophotosensitive material of the single-layer type, between the substrate and the photosensitive layer and, for the electrophotosensitive material of the multilayer type, between the substrate and the charge-generating layer or between the substrate and the charge-transferring layer and between the charge-generating layer and the charge-transferring layer. Further, a protective layer may be formed on the surface of the electrophotosensitive material.

To form the charge-generating layer or the charge-transferring layer with the use of coating methods, the charge-generating material or the charge-transferring material may be mixed with binding resin or the like with the use of conventional methods such as a roll mill, a ball mill a paint shaker, an atriter, a supersonic dispenser or the like, and the resultant mixture may be applied onto the conductive substrate with the use of conventional coating methods, and then allowed to dry.

As described hereinbefore, the electrophotosensitive material of the present invention has high sensitivity since it contains the compound represented by the general formula [I] which is hard to be crystallized.

Further, the electrophotosensitive material of the present invention may be economically manufactured since the compound represented by the general formula [I] presents a high yield to assure a high productivity.

EXAMPLES

The following description will discuss in more detail with reference to Reference Examples, Examples and Comparative Examples.

Reference Example 1

Synthesis of
N,N'-di(3-toryl)-N,N'-di(4-toryl)-1,3-phenylenediamine

First, 11 grs. of resorcinol, 22.6 grs. of m-toluidine and 0.5 gr. of iodine were reacted at reflux in a stream of nitrogen for three days. After the reaction, the reacted product was cooled to a room temperature and the resultant solid body was washed with 500 ml of methanol to prepare N,N'-di(3-toryl)-1,3-phenylenediamine. Then, 14.4 grs. of N,N'-di(3-toryl)-1,3-phenylenediamine, 20.4 grs. of p-iodotoluene, 9.7 grs. of potassium carbonate and 2 grs. of copper powder were reacted at reflux in 100 ml of nitrobenzene for 24 hours. After the reaction, nitrobenzene and p-iodotoluene were removed by distillation of vapor and the residue was washed with water and methanol. Then, the residue was added to 900 ml of benzene, and the water soluble substance was filtered and applied to active almina column chromatography using a benzene-hexane mixture (at 1:1) as a developing solvent to obtain the 1st fraction. The 1st fraction was applied to active almina column chromatography using a benzene-hexane mixture (at 1:2) as a developing solvent to obtain the 1st fraction (2).

The solvent of the 1st fraction (2) was removed, a portion of the residue was dissolved in acetonitrile at an ambient temperature and the solution was cooled down to obtain the crystal. The remaining residue was dissolved in acetonitrile and recrystallized using the above mentioned crystal as a core, to obtain N,N'-di-(3-toryl)-N,N'-di(4-toryl)-1,3-phenylenediamine (compound containing substituents at the para- and meta- positions).

Reference Example 2

Synthesis of
N,N,N'N'-tetrakis(3-toryl)-1,3-phenylenediamine

First, 14.4 grs. of N,N'-di(3-toryl)-1,3-phenylenediamine obtained in the same manner as in Reference Example 1, 21.8 grs. of m-iodotoluene, 9.7 grs. of potassium carbonate, and 2 grs. of copper powder were reacted at reflux in 100 ml of nitrotoluene for 24 hours. After the reaction, nitrobenzene and m-iodotoluene were removed by distillation and the residue was washed with water and methanol. The residue was added to 900 ml of benzene and the water soluble substance was filtered and applied to active almina column chromatography using a benzene-hexane mixture (at 1:2) as a developing solvent to obtain the 1st fraction. The 1st fraction was applied to active almina column chromatography using a benzene-hexane mixture (at 1:2) as a developing solvent to obtain the 1st fraction (2).

The solvent of the 1st fraction (2) was removed, a portion of the residue was dissolved in acetonitrile at an ambient temperature and the solution was cooled down to obtain the crystal. The remaining residue was dissolved in acetonitrile and recrystallized using the above mentioned crystal as a core, to obtain N,N,N''-tetrakis(3-toryl)-1,3-phenylenediamine (compound containing substituents at the meta-positions).

Reference Example 3

Synthesis of
N,N,N'N'-tetrakis(4-toryl)-1,3-phenylenediamine

With the use of 22.6 grs. of P-toluidine instead of m-toluidine used in Reference Example 1, N,N'-di(4-toryl)-1,3-phenylenediamine was obtained in the same manner as in Reference Example 1. Then, 14.4 grs. of N,N'-di(4-toryl)-1,3-phenylenediamine, 20.4 grs. of p-iodotoluene, 9.7 grs. of potassium carbonate and 2 grs. of copper powder were reacted at reflux in 100 ml of nitrobenzene for 24 hours. After the reaction, nitrobenzene and p-iodotoluene were removed by distillation of vapor and the residue was washed with water and methanol. The residue was then added to 900 ml of benzene and the water soluble substance was filtered and applied to active almina column chromatography using a benzene-hexane mixture (at 1:1) as a developing solvent to obtain the 1st fraction. The 1st fraction was applied to active almina column chromatography using a benzene-hexane mixture (at 1:2) as a developing solvent to obtain the 1st fraction (2).

The solvent of the 1st fraction (2) was removed, a portion of the residue was dissolved in acetonitrile at an ambient temperature and the solution was cooled down to obtain the crystal. The remaining residue was dissolved in acetonitrile and recrystallized using the above mentioned crystal as a core, to obtain N,N,N'N'-tetrakis(4-toryl)-1,3-phenylenediamine (compound containing substituents at the para-positions).

[Preparation of Electrophotosensitive Material]

Example 1

With a supersonic dispenser, a dispersion solution was prepared with the use of (i) 8 parts by weight of N,N'-di(3,5-dimethylphenyl)perylene-3,4,9,10-tetracarboxydiimide as the charge-generating material, (ii) 50 parts by weight of N,N'-di(3-toryl)-N,N'-di(4-toryl)-1,3-phenylenediamine (compound containing substituents at the para- and meta-positions) as the charge-transferring material, (iii) 100 parts by weight of polycarbonate resin as the binding resin, and (iv) a predetermined amount of tetrahydrofuran. The dispersion solution thus prepared was applied onto an anodized aluminium sheet, thereby to prepare a single-layer type electrophotosensitive material having a sensitive layer having a thickness of 23 μm.

Example 2

A single-layer type electrophotosensitive material was prepared in the same manner as for Example 1, except that 70 parts by weight of N,N'-di(3-toryl)-N,N'-di(4-toryl)-1,3-phenylenediamine (compound containing substituents at the para- and meta-positions) used as the charge-transferring material.

Example 3

A single-layer type electrophotosensitive material was prepared in the same manner as for Example 1, except that 90 parts by weight of N,N'-di(3-toryl)-N,N'-di(4-toryl)-1,3-phenylenediamine (compound containing substituents at the para-and meta-positions) used as the charge-transferring material.

Comparative Example 1

A single-layer type electrophotosensitive material was prepared in the same manner as for Example 1, except that 70 parts by weight of N,N,N',N'-tetrakis-(4-toryl)-1,3-phenylenediamine (compound containing substituents at the para-positions) used as the charge-transferring material.

Comparative Example 2

A single-layer type electrophotosensitive material was prepared in the same manner as for Example 1, except that 100 parts by weight of N,N,N,N'-tetrakis-(4-toryl)-1,3-phenylenediamine (compound containing substituents at the para-positions) used as the charge-transferring material.

Example 4

With a suspersonic dispenser, a dispersion solution was prepared with the use of (i) 10 parts by weight of N,N'-di(3,5-dimethylphenyl)perylene3,4,9,10-tetracarboxydiimide as the charge-generating material, (ii) 10 parts by weight of a vinyl chloride-vinyl acetate copolymer as the binding resin, and (iii) a predetermined amount of tetrahydrofuran. The dispersion solution thus prepared was applied onto an aluminium sheet and allowed to dry at 100° C. for 30 minutes. Thus, a charge-generating layer having a thickness of 0.5 μm was prepared.

A dispersion solution was prepared with the use of (i) 70 parts by weight of N,N'-di(3-toryl)-N,N'-di(4-toryl)-1,3-phenylenediamine (compound containing substituents to the meta- and para-positions) as the charge-transferring material, (ii) 100 parts by weight of polycarbonate resin as the binding resin and (iii) a predetermined amount of benzene. The dispersion thus prepared was applied to the charge-generating layer, thereby to prepare a charge-transferring layer having a thickness of 20 μm. Thus, a multilayer-type electrophotosensitive material was prepared.

Comparative Example 3

A multilayer-type electrophotosensitive material was prepared in the same manner as for Example 4, except that 70 parts by weight of N,N,N',N'-tetrakis-(4-toryl)-1,3-phenylenediamine (compound containing substituents at the para-positions) used.

[Evaluation of the Electrophotosensitive Materials]

The characteristics of electrification and sensitivity of the electrophotosensitive materials above-mentioned were tested. With the use of a drum sensitivity testing machine (GENTECSINCIRE 30M manufactured by Gentec), each of the electrophotosensitive materials was electrified in positive and the surface potential Vsp(V) thereof was measured. With the use of halogen light, each electrophotosensitive material was exposed, and the time until the surface potential above-mentioned became to ½, was measured so that the half-reduced exposure amount $E\frac{1}{2}(\mu J/cm^2)$ was calculated. After the exposure, the surface potential of each electrophotosensitive material after the passage of 0.15 second was measured as a residual potential Vrp(V). The crystallization of each electrophotosensitive material was visually checked whether or not each electrophotosensitive material was crystallized.

Table 2 shows the measurement results of the characteristics of electrification and sensitivity of the electrophotosensitive materials of Examples and Comparative Examples.

TABLE 2

| | Vsp (V) | E 1/2 (μJ/cm2) | Vrp (V) | Crystallization |
|---|---|---|---|---|
| Example 1 | 705 | 19.5 | 80 | ○ |
| Example 2 | 700 | 18.0 | 72 | ○ |
| Example 3 | 690 | 17.8 | 73 | ○ |
| Comparative Example 1 | — | — | — | X |
| Comparative Example 2 | — | — | — | X |
| Example 4 | 715 | 21.7 | 58 | ○ |
| Comparative Example 3 | — | — | — | X |

○: Not crystallized
X: Crystallized

The electrophotosensitive materials of Comparative Examples were crystallized and therefore the electrophoto characteristics thereof could not be evaluated.

As apparent from Table 2, all the electrophotosensitive materials of the present invention are not crystallized and present excellent electrification characteristics. Further, all the electrophotosensitive materials of the present invention present a small half-reduced exposure amount, good sensitivity and a small residual potential. On the other hand, the sensitive materials of Comparative Examples are disadvantageously crystallized.

What is claimed is:

1. An electrophotosensitive material comprising a conductive substrate and a single layer type photosensitive layer provided on said conductive substrate, said photosensitive layer containing a m-phenylenediamine compound as charge-transferring material and a perylene compound as charge-generating material, said m-phenylenediamine compound represented by formula

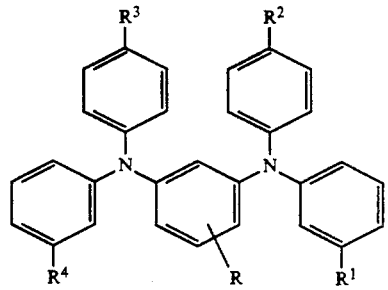

wherein $R^1$, $R^2$, $R^3$, $R^4$ and R are the same as one another, or are different from one another, and represent a hydrogen atom, an alkyl group, an alkoxy group or a halogen atom, provided that, when one of $R^1$ and $R^4$ is the hydrogen atom, the other should not be the hydrogen atom, and when one of $R^2$ and $R^3$ is the hydrogen atom, the other should not be the hydrogen atom.

2. An electrophotosensitive material according to claim 1, wherein the m-phenylenediamine compound represented by the general formula [I] is N,N'-di(3-toryl)-N,N'-di(4-toryl)-1,3-phenylenediamine.

3. An electrophotosensitive material according to claim 1, wherein the photosensitive layer contains 20 to 80 parts by weight of the m-phenylenediamine compound represented by the general formula [I] with respect to 100 parts by weight of binding resin.

4. The electrophotosensitive material according to claim 1, wherein said m-phenylenediamine compound is N,N'-di)3-toryl)-N,N'-di(4-toryl)-1,3-phenylenediamine.

* * * * *